United States Patent [19]

Choy

[11] 4,307,474

[45] Dec. 29, 1981

[54] PASSIVE DOSING DISPENSER EXHIBITING IMPROVED RESISTANCE TO CLOGGING

[75] Inventor: Clement K. Choy, Danville, Calif.

[73] Assignee: The Procter & Gamble Company, Cincinnati, Ohio

[21] Appl. No.: 153,997

[22] Filed: May 28, 1980

[51] Int. Cl.[3] ..... E03D 9/02

[52] U.S. Cl. ..... 4/228; 4/227; 222/424.5

[58] Field of Search ..... 4/222, 227, 228; 222/424.5, 416, 204, 57, 54

[56] References Cited

U.S. PATENT DOCUMENTS

| | | | |
|---|---|---|---|
| 650,161 | 5/1900 | Williams et al. | 4/228 |
| 1,175,032 | 3/1916 | Williams | 4/228 |
| 3,121,236 | 2/1964 | Yadro et al. | 4/228 |
| 3,407,412 | 10/1968 | Spear | 4/228 |
| 3,423,182 | 1/1969 | Klasky | 4/228 X |
| 3,444,566 | 5/1969 | Spear | 4/228 X |
| 3,769,640 | 11/1973 | Castronovo | 4/228 |
| 3,772,715 | 11/1973 | Nigro | 4/228 X |
| 3,778,849 | 12/1973 | Foley | 4/228 X |
| 3,781,926 | 1/1974 | Levey | 4/228 |
| 3,831,205 | 8/1974 | Foley | 4/228 |
| 3,869,069 | 3/1975 | Levey et al. | 4/228 |
| 3,934,279 | 1/1976 | Mallin | 4/228 |
| 3,943,582 | 3/1976 | Daerinckx et al. | 4/227 |
| 3,952,339 | 4/1976 | Baur et al. | 4/228 |
| 4,064,572 | 12/1977 | Wick et al. | 4/227 |
| 4,171,546 | 10/1980 | Dinksing | 4/227 X |
| 4,186,856 | 6/1980 | Dirksing | 222/424.5 |
| 4,208,747 | 2/1980 | Dirksing | 4/227 X |
| 4,216,027 | 8/1980 | Wages | 4/228 X |

*Primary Examiner*—Henry K. Artis

*Attorney, Agent, or Firm*—E. Kelly Linman; John V. Gorman; Richard C. Witte

[57] ABSTRACT

A passive dosing dispenser for issuing, for example, a predetermined volume of a liquid toilet tank additive solution into a toilet tank as the water is draining therefrom while the toilet is flushing. A preferred dispenser comprises an internal reservoir having a product chamber for containing a quantity of a solid type product which can be dissolved in water to form a toilet tank additive product solution and a liquid solution reservoir for containing a quantity of said solution in fluid communication with said product chamber, and inlet/discharge conduit having its lowermost end in fluid communication with said liquid solution reservoir and its uppermost end in fluid communication with a syphon tube, and air trap disposed adjacent said inlet/discharge conduit for isolating said liquid product solution from the toilet tank water in said syphon tube during quiescent periods, and an air vent in fluid communication with said liquid solution reservoir and said product chamber. To accommodate solid type products which have a tendency to form a gel while dissolving, novel clog prevention, i.e., anti-clogging means are provided within the dispenser to limit the amount of non-gelled solid product exposed to liquid and to maximize the area of contact between the liquid contained within the dispenser and the gelled product. The novel anti-clogging means helps ensure that dispensing of a predetermined quantity of the liquid solution will occur with each flush cycle of the toilet.

20 Claims, 14 Drawing Figures

PASSIVE DOSING DISPENSER EXHIBITING IMPROVED RESISTANCE TO CLOGGING

TECHNICAL FIELD

The present invention pertains, in general, to providing a dosing type dispenser for such products as liquefied toilet tank additives: for instance, disinfectants, aerosolization retardants, and the like. More specifically, the present invention provides an entirely passive (no moving parts) dispenser in which a solid type product will gradually be dissolved to form a solution, and from which dispenser such solution will be incrementally issued: a predetermined quantity or dose-volume of solution being issued each time the water in the toilet tank recedes from around the dispenser. In particular, dispenser embodiments of the present invention permit effective dispensing of liquid solutions formed from solid type products which have a tendency to form hydrated gels while undergoing dissolution. Dispenser embodiments of the present invention also provide means for make-up water to enter the dispenser, and air-lock isolation of the solid product, the incompletely dissolved gel and the liquid product solution within the dispenser from the surrounding toilet tank water during quiescent periods. Plural product dispenser embodiments are also provided which can, because each segment provides isolation from the toilet tank water during quiescent periods, co-dispense solutions of two or more products which should not be mixed before their intended use.

BACKGROUND ART

Passive dosing dispensers of various geometries are disclosed in prior art patents. For instance, U.S. Pat. No. 650,161 which issued to J. Williams et al. on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to L. V. Nigro on Nov. 20, 1973, and U.S. Pat. No. 3,781,926 which issued to J. Levey on Jan. 1, 1974, and U.S. Pat. No. 3,943,582 which issued to J. Daeninckx et al. on Mar. 16, 1976 disclose passive dispensers which are alternately flooded and then gravitationally drained. Moreover, U.S. Pat. No. 3,407,412 which issued to C. T. Spear on Oct. 29, 1968, and U.S. Pat. No. 3,444,566 which issued to C. T. Spear on May 20, 1969 disclose dispensers which, although they have no moving parts, must be connected to a pressurized water supply such as the trap refill tube in a toilet tank and in which the direction of flow alternates in labyrinth passages.

Passive dosing dispensers of the type disclosed in the commonly assigned patent application of Robert S. Dirksing entitled PASSIVE DOSING DISPENSER EMPLOYING TRAPPED AIR BUBBLE TO PROVIDE AIR-LOCK, Ser. No. 002,524, filed Jan. 11, 1979, which is hereby incorporated herein by reference, have solved many of the problems associated with the aforementioned prior art dispensers, most particularly the problem of providing solid product and liquid product solution isolation from surrounding toilet tank water during quiescent periods. Dispenser embodiments of the type generally disclosed in FIGS. 1 and 15–18 of the aforesaid patent application of Robert S. Dirksing have been found particularly suitable for dispensing liquid solutions formed from solid products containing a surfactant. However, when the solid product exhibits a substantial tendency to form a hydrated gel while undergoing dissolution, even dispensers of the type disclosed in FIGS. 1 and 15–18 of the aforementioned patent application of Robert S. Dirksing may function with less than complete reliability due to the presence of excessive quantities of the incompletely dissolved gel within the dispenser.

DISCLOSURE OF INVENTION

In accordance with one aspect of the invention, a dispenser is provided which comprises an internal reservoir having a product chamber for containing a quantity of a solid product in fluid communication with a liquid solution reservoir for containing a quantity of liquid product solution, and means for causing a predetermined quantity or dose-volume of said liquid solution to be conducted from said liquid solution reservoir and issue from the dispenser in response to the level of a body of liquid in which said dispenser is immersed being lowered from a first elevation to a second elevation. Such a dispenser can comprise an internal reservoir having a product chamber and a liquid solution reservoir in fluid communication therewith, a syphon tube extending downwardly from said liquid solution reservoir and having an open lower end, an inlet/discharge conduit having an air trap disposed adjacent thereto, said conduit having its lowermost end in fluid communication with said liquid solution reservoir and its uppermost end in fluid communication with the uppermost end of said syphon tube, and an air vent in fluid communication with said liquid solution reservoir and product chamber.

The air trap disposed adjacent the inlet/discharge conduit acts to retain an air bubble when water enters the liquid product solution reservoir via the syphon tube and inlet/discharge conduit as the water in the toilet tank returns to the FULL level. As long as water is flowing inwardly through the inlet/discharge conduit the air bubble is retained in the trap. However, when the air vent in fluid communication with the liquid solution reservoir is blocked by the rising water level in the toilet tank and forms an air-lock between the liquid solution within the liquid solution reservoir and the toilet tank water or when the water level in the toilet tank ceases to rise in the event this occurs prior to blockage of the air vent, the inward flow of water through the syphon tube and inlet/discharge conduit ceases, and, due to the geometry of the inlet/discharge conduit, the air trap, and the connecting passageway joining the syphon tube and the inlet/discharge conduit, the trapped air bubble relocates itself into the headspace joining the upper reaches of the inlet/discharge conduit and the syphon tube. This isolates the liquid product solution contained in the liquid product solution reservoir and the inlet/discharge conduit from the toilet tank water in the syphon tube until the next flush cycle. As a result, the solid product, the incompletely dissolved gel and the liquid product solution are completely isolated from the surrounding toilet tank water during quiescent periods intermediate flush cycles.

To accommodate solid type products which have a substantial tendency to form a gel while dissolving, novel anti-clogging means are provided within the product chamber to limit the amount of non-gelled solid product exposed to liquid and to maximize the area of contact between the liquid contained within the dispenser and the gelled product. In a preferred embodiment, said anti-clogging means comprise support means in the lowermost portion of the product chamber for the solid product and level control means to control the liquid level within the product chamber. Because the aforementioned solid product support means and level control means minimize the area of interface between the non-gelled solid product and the liquid contained within the dispenser during quiescent periods, they minimize the quantity of gel formed within the dispenser when long periods of time elapse between flush cycles of the toilet. Furthermore, said support means help prevent the gelled portion of said solid product from obstructing the flow of liquid into and out of the product chamber. Thus, the support means also serve to maximize the area of contact between the liquid contained within the dispenser and the gelled product.

So long as liquid can enter and exit the product chamber during each flush cycle of the toilet, the gel will continue to dissolve or disperse into liquid solution which ultimately settles into the liquid solution reservoir located generally beneath the product chamber. Accordingly, the tendency of the incompletely dissolved gel to clog the present dispenser is minimized. It is in this manner that the novel anti-clogging means of the present invention helps ensure that dispensing of a predetermined quantity of liquid solution will occur with each flush cycle of the toilet.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
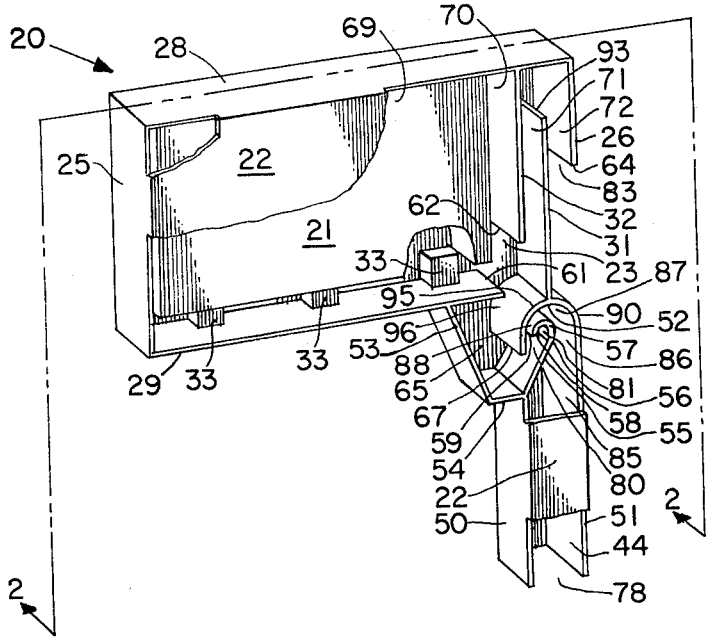
FIG. 1 is a partially torn away perspective view of a passive dosing dispenser which is an embodiment of the present invention.

Referring now to the figures in which identical features are identically designated, FIG. 1 shows a preferred dispenser 20 embodying anti-clogging means of the present invention and containing a solid-state, water soluble product 21. Dispenser 20 comprises a front wall 22, a back wall 23, sidewall segments 25, 26, 31, 50, 51, 52 and 90, a top wall 28, bottom wall segments 29, 53 and 54, interior partitions 32, 55, 56, 57, 58, 91, 95 and 96, and solid product support members 33. The solid product support members 33 are of lesser thickness than the width of the dispenser wall segments to ensure that liquid can wash across the lowermost surface of solid product 21 along its entire length. The walls and partitions are rigid and define a liquid solution reservoir 65, a solid product chamber 69, a syphon tube 44 having uppermost vertical passageways 85 and 86, a horizontal passageway 87, a vertical passageway 88 connecting with inlet/discharge conduit 80, said inlet/discharge conduit having an air trap 81 disposed adjacent thereto, and vent means for the product chamber comprising passageways 71 and 72 and air vent 83. The lowermost edge of partition segment 58 is designated 59, the lowermost edge of partition segment 96 is designated 67, the exposed edge of bottom wall segment 29 is designated 61, the lowermost edge of level control partition 32 is designated 62, the uppermost edge of sidewall segment 31 is designated 93, and the lowermost edge of sidewall segment 26, which in conjunction with front and back walls 22 and 23, respectively, and sidewall segment 31 define air vent 83, is designated 64. The inlet/discharge port of dispenser 20 located at the lowermost end of syphon tube 44 is designated 78.

In the case of dispenser 20, the lowermost portion of product chamber 69 coincides with bottom wall segment 29. Liquid solution reservoir 65 and product chamber 69 together comprise what is hereinafter collectively referred to as an internal reservoir.

Figure 2:
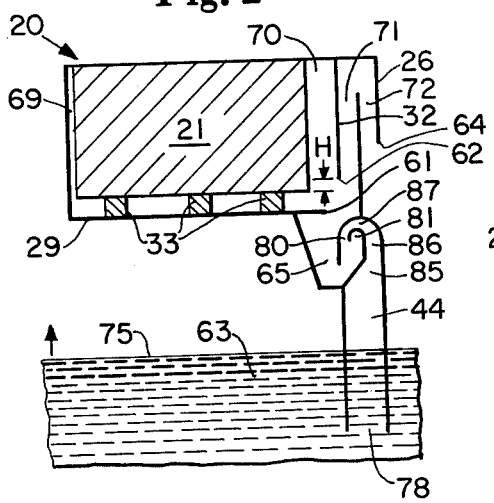
FIGS. 2, 3, 5, and 7–10 are simplified, sequential sectional views which show a portion of a cycle of the dispenser shown in FIG. 1, said views being taken along section line 2—2 of FIG. 1.

Referring to FIG. 2, when a dispenser 20 containing solid product 21 is disposed, for instance, in a toilet tank (not shown) on a bracket or other mounting means (not shown) so that the FULL level of water 63 in the toilet tank is sufficiently high to at least reach edge 64 of sidewall segment 26, the dispenser will respond as shown in FIGS. 2–10 as the level of water rises to the FULL position in the toilet tank and the toilet is thereafter flushed.

The dispenser 20 illustrated in FIG. 2 is shown prior to immersion in the toilet tank water 63. The depth of immersion of solid product 21 is controlled by the vertical distance "H" between the uppermost surface of product support members 33 and lowermost edge 62 of level control partition 32. Where the solid product 21 has a significant tendency to gel, it is preferred to minimize the amount of interface between the solid product and the liquid contained within the dispenser 20. This factor is particularly important in dispenser embodiments employing product chambers which have a relatively small or restricted area of fluid communication with the liquid solution reservoir in the dispenser. With dispenser embodiments of the type generally shown in FIG. 1 it has generally been found that vertical distance "H" should be less than about $\frac{3}{8}$ inch, and most preferably less than about $\frac{1}{8}$ inch. In general, the greater the gelling tendency of solid product 21 and the smaller the area of fluid communication between the product chamber and the liquid solution reservoir, the smaller should be the depth of immersion "H".

Solid product support members 33 help to ensure that liquid can wash across the lowermost surface of solid product 21 during flush cycles of the toilet. Accordingly, they are positioned in the lowermost portion of product chamber 69 and sized so as to minimize flow obstruction. The style and quantity of product support members employed in the practice of the present invention may take many different forms, such as dowels, planar shelves, or other protuberances secured to the front and/or back walls or extending from bottom wall segment 29 of dispenser 20. It has in general been found that for solid products exhibiting a strong gel forming tendency a greater support area is preferred, since this tends to slow the rate at which solid product 21 settles.

An exemplary dispenser embodiment of the present invention employing two shelf-like support members secured to and projecting from back wall 23, each of said support members having an overall height of about 0.7 inches, as measured from bottom wall segment 29, and an uppermost surface area of approximately 0.35 square inches each, has been found to function without clogging when allowed to stand in 75° F. water for periods of up to about four days with a surfactant-containing solid product of the type generally disclosed in the concurrently filed patent application of Clement K. Choy, entitled POLY(ETHYLENE OXIDE) COMPOSITIONS WITH CONTROLLED SOLUBILITY CHARACTERISTICS, Ser. No. 153,993 filed May 28, 1980, (Attorney's Docket No. 2791), said patent application being hereby incorporated herein by reference. A vertical distance "H" of about 0.3 inches between the uppermost surface of the support members and the lowermost edge of the level control partition was employed. The solid product in question initially weighed about 60 grams and had a lowermost surface measuring about 2.0 inches in length by about 0.5 inches in width.

Figure 3:
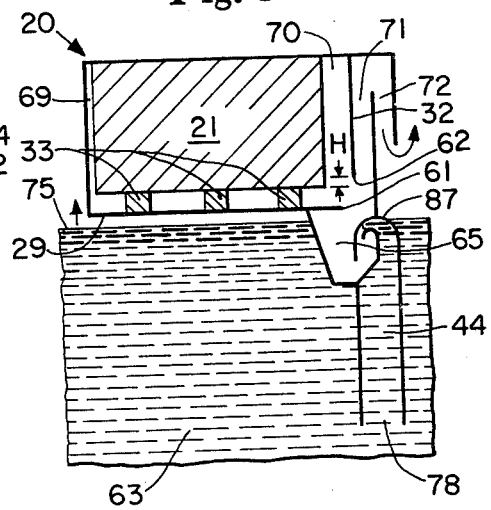
Figure 4:
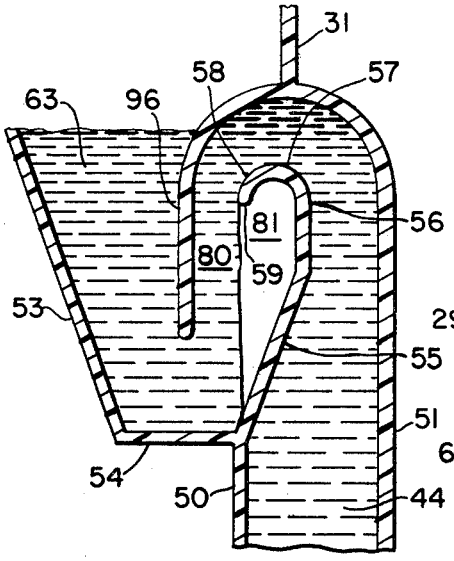
FIG. 4 is an enlarged fragmentary sectional view of the air trap portion of the dispenser of FIG. 1.

Referring to FIGS. 3 and 4, as the toilet tank water 63 rises, it enters syphon tube 44 through inlet/discharge port 78. Air within the upper reaches of the syphon tube is allowed to vent through vertical passageways 85 and 86, horizontal passageway 87, vertical passageway 88, inlet/discharge conduit 80, liquid product solution reservoir 65, vent passageways 71 and 72 and air vent 83. As the level of the toilet tank water 63 continues to rise, FIG. 3, it begins to enter horizontal passageway 87. Because the difference in elevation of the water in the toilet tank and the water within the syphon tube is relatively small prior to air vent 83 becoming blocked, the water head or water pressure available to force the water in syphon tube 44 around the loop through vertical passageway 88 and into inlet/discharge conduit 80 is likewise quite small. To minimize the required driving force to initiate water flow through the loop, the dispenser 20 preferably employs a series of passageways 85, 86, 87 and 88, each of which is smaller in cross-section than any portion of the one immediately preceding it, thereby providing capillary suction in the direction of flow which tends to draw the water from the syphon tube 44 into the inlet/discharge conduit 80. This feature is more clearly illustrated in the enlarged fragmentary view of FIG. 4. It is of course recognized that a maximum degree of capillary suction may be provided by employing passageways 86, 87 and 88 having characteristics similar to passageway 85 which exhibits a continual reduction in cross-section in the direction of liquid flow during the dispenser charging operation. If desired, the entire length of the syphon tube 44 may be convergent in the direction of water flow during the charging operation.

Once toilet tank water 63 enters inlet/discharge conduit 80 and begins to collect in liquid product solution reservoir 65, the condition illustrated in FIG. 4 prevails in the air trap 81 disposed adjacent inlet/discharge conduit 80. Namely, an air bubble is retained within the confines of the air trap 81 defined by partition segments 55, 56, 57 and 58. The condition illustrated in FIG. 4 persists as long as toilet tank water 63 continues to enter the dispenser 20.

Figure 5:
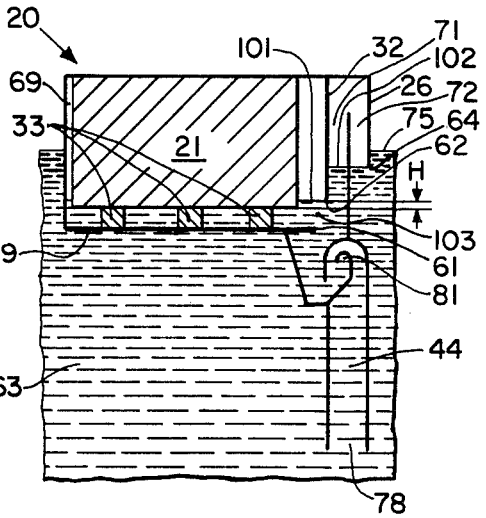
Figure 6:
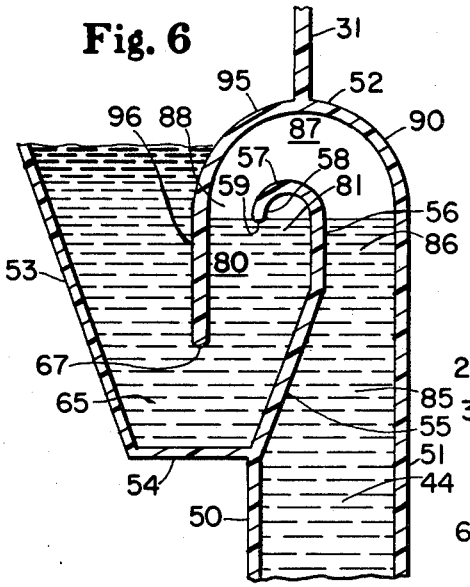
FIG. 6 is an enlarged fragmentary sectional view of the air trap portion of the dispenser of FIG. 1 in the condition illustrated in FIG. 5.

When the level 101 of incoming liquid within dispenser product chamber 69 reaches lowermost edge 62 of level control partition 32, an air-lock is formed in the uppermost reaches of the product chamber 69, thereby preventing the liquid level 101 from rising further within the product chamber. As shown in FIG. 5, the lowermost portion of solid product 21 is thereby immersed a distance "H" into the liquid contained in product chamber 69. It should be noted, however, that the solution level 102 in passageway 71 continues to rise until such time as the toilet tank water 63 contacts lowermost edge 64 of sidewall segment 26 and blocks air vent 83, thus providing a secondary air-lock in the uppermost reaches of passageway 71 and passageway 72. This secondary air-lock isolates the liquid product solution 103 formed by dissolution of the solid product 21 in the toilet tank water introduced during the charging cycle and the toilet tank water blocking air vent 83. As is apparent from FIG. 5, the level 102 of liquid within dispenser passageway 71 is identical to the level of toilet tank water 63 in passageway 72. The level 102 of liquid in passageway 71 is distinct from the level 101 of the liquid within product chamber 69 due to the presence of level control partition 32 in the illustrated embodiment. Should level control partition 32 be eliminated, the dispenser 20 would still function. However, the level of liquid within the product chamber 69, and hence the depth of immersion of solid product 21, would be controlled exclusively by the vertical location of air vent 83, assuming the FULL level of the toilet tank is above the air vent.

In the event the FULL level of the toilet tank is below the air vent 83, the level 102 of liquid in passageway 71 will be identical to the level 75 of toilet tank water 63 surrounding the dispenser, while the level 101 of liquid within product chamber 69 will be controlled by lowermost edge 62 of level control partition 32. It should, of course, be recognized that there must be sufficient liquid introduced into dispenser 20 to make contact with at least the gel portion 621 of solid product 21 in order for the dispenser to form a liquid product by either dissolution or dispersion.

In the event level control partition 32 is eliminated and the FULL level of the toilet tank is below the air vent 83, the level of liquid within the dispenser 20 will be identical to the level 75 of toilet tank water 63 surrounding the dispenser 20. In all cases, dispenser 20 will function to isolate the resultant liquid product solution 103 contained in the upper reaches of product chamber 69 from the surrounding toilet tank water 63, whether or not air vent 83 is blocked by toilet tank water. In the event air vent 83 is blocked by tank water, isolation is provided by means of an air-lock created in the upper reaches of passageway 72. In the event air vent 83 is not blocked by tank water, the vent to atmosphere provides the desired isolation from the toilet tank water.

Figure 13:
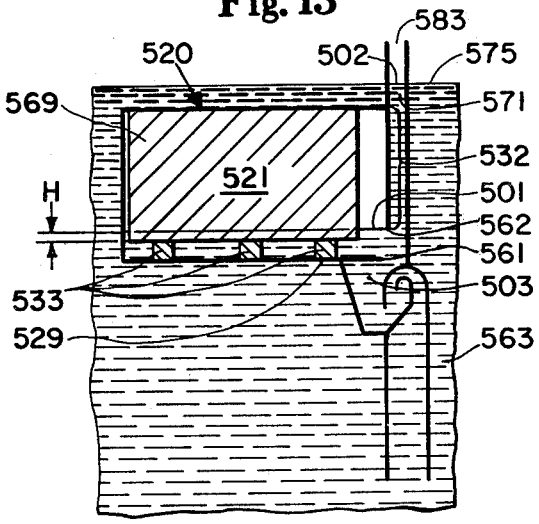
FIG. 13 is a simplified schematic illustration of another embodiment of the present invention shown immediately after the water has reached its FULL level in the toilet tank.

By way of contrast, dispenser embodiment 520 of the present invention illustrated in FIG. 13 must be so positioned in the toilet tank that the air vent 583 remains vented to atmosphere at all times, i.e., the air vent must be maintained above the FULL level of the toilet tank to ensure isolation of the solution contained within the dispenser from the surrounding toilet tank water.

The dispenser embodiment 520 illustrated in FIG. 13 is, with the exception of reconstruction and relocation of air vent 583, similar to dispenser embodiment 20. Solid product support members 533, correspond to solid product support members 33 of dispenser 20, and their uppermost surfaces are likewise separated by a vertical distance "H" from the lowermost edge 562 of level control partition 532. However, passageway 72 has been eliminated from dispenser 20 and passageway 71 has been vertically extended beyond top wall 28 of dispenser 20 to form a single vertical passageway 571 in dispenser embodiment 520. Lowermost edge 562 of level control partition 532, which corresponds to lowermost edge 62 of level control partition 32 in dispenser 20, fixes the level 501 of the resultant liquid product solution 503 formed by dissolution of solid product 521 within chamber 569, while the level 502 of liquid product solution 503 in passageway 571 is identical to the level 575 of the surrounding toilet tank water 563. As will be apparent from an inspection of FIG. 11, air vent 583 must at all times be maintained above the FULL level 575 of the toilet tank water 563 to ensure isolation of the liquid product solution 503 from the tank water. This is so because, unlike dispenser embodiment 20, vertical passageway 571 has no provision for forming an air-lock if the dispenser air vent 583 is immersed. Should level control partition 532 be eliminated, liquid level control within the product chamber of the dispenser, and hence the depth of immersion of solid product 521, could be controlled by careful vertical placement of the dispenser relative to the FULL level of the toilet tank. A mark or other indicia could be provided on the exterior of the dispenser to facilitate such placement.

Referring again to FIG. 5, which represents the condition of the dispenser 20 when the toilet tank water level 75 has reached its FULL position, the bulk of the air bubble retained within air trap 81 during the charging operation has rotated about edge 59 of partition segment 58 so as to substantially fill horizontal passageway 87 as well as the uppermost portions of vertical passageways 86 and 88, thereby isolating the resultant liquid product solution 103 contained within the inlet/-discharge conduit 80 from the toilet tank water 63 contained within passageway 86 of syphon tube 44. This feature is more clearly illustrated in FIG. 6, which is an enlarged fragmentary view of the air trap portion of the dispenser 20 illustrated in FIG. 5. It is thus clear that the resultant liquid product solution 103 contained within passageway 71, product chamber 69, liquid solution reservoir 65 and inlet/discharge conduit 80 is completely isolated from toilet tank water 63 by means of the air-lock provided in the uppermost sections of passageways 71 and 72 and the air-lock provided in the uppermost sections of passageways 86, 88 and horizontal passageway 87.

As will be appreciated by those skilled in the art, the toilet tank water brought into contact with solid product 21 during the charging cycle will continue to dissolve the solid product at least until such time as the product solution 103 becomes saturated or until such time as the toilet is flushed and a predetermined quantity or dose-volume of the liquid solution is dispensed. As will also be appreciated by those skilled in the art, the exterior surfaces of solid product 21 are preferably so configured as to permit a uniform degree of surface exposure to the solution 103 along the entire length and width of the solid product. To this end, the exterior surfaces of the solid product may be longitudinally grooved, etc.

Solid product compositions for use in automatic toilet tank dispensers may be specifically formulated to provide cleansing, disinfecting, deodorizing and/or other desired results. One such result found particularly useful is treatment of the flush water of toilets in order to reduce the tendency of such flush water to produce aerosolization during the flushing of the toilet. Decreased aerosolization reduces the possibility of airborne transmission of disease causing organisms from the toilet wastewater. Such solid product compositions typically comprise a poly(ethyleneoxide)resin, a surfactant and a water-soluble salt. However, it has been found that when solid product compositions comprising high molecular weight poly(ethylene oxide) resins (i.e. molecular weights of from about 500,000 to about 7,000,000) are utilized in prior art automatic dispensers, the resin forms a thick gel when exposed to the limited volume of water within the dispenser, thereby retarding or even completely blocking the subsequent flow of dissolved and/or dispersed materials out of the dispenser and into the flush water.

Accordingly, it is highly desirable to provide such solid cake compositions comprising poly(ethylene oxide), which compositions have a reduced tendency to form gels when exposed to water. A particularly preferred solid product composition having a greatly reduced gel forming tendency is disclosed in the concurrently filed patent application of Clement K. Choy, entitled POLY(ETHYLENE OXIDE) COMPOSITIONS WITH CONTROLLED SOLUBILITY CHARACTERISTICS, Ser. No. 153,993 filed May 28, 1980, (Attorney's Docket No. 2791), said patent application being incorporated herein by reference.

Dispenser embodiments of the present invention have generally exhibited improved reliability in dispensing liquid solutions formed by dissolving solid products having a gel forming tendency when compared to dispenser embodiments of the type disclosed in FIGS. 1 and 15–18 of the commonly assigned patent application of Robert S. Dirksing entitled PASSIVE DOSING DISPENSER EMPLOYING TRAPPED AIR BUBBLE TO PROVIDE AIR-LOCK, Ser. No. 002,524, filed Jan. 11, 1979, said patent application being incorporated herein by reference. The aforementioned improvement in reliability of dispenser embodiments of the present invention is readily demonstrable with solid-state compositions of the type disclosed in the aforementioned patent application of Clement K. Choy entitled POLY(ETHYLENE OXIDE) COMPOSITIONS WITH CONTROLLED SOLUBILITY CHARACTERISTICS. The dissolution of such a solid product 21 and the dispensing of a predetermined quantity of liquid solution 103 formed therefrom in accordance with the present invention is schematically illustrated in FIGS. 5–10.

Dissolution of the formula matrix of which such a gel forming solid product 21 is comprised typically involves a three stage process. The first stage involves hydration of the solid product 21 to form a hydrated gel 621 illustrated in FIGS. 7–10. The second stage involves dispersion of the hydrated gel 621 in the lowermost portion of product chamber 69 to form a liquid solution 103 comprised of toilet tank water and the dissolved solid product 21. The third stage involves distribution of the liquid product solution 103 throughout the interior of the dispenser 20, i.e., throughout liquid solution reservoir 65, the lowermost portion of product chamber 69 and the lowermost portion of vertical passageway 71.

As is shown in FIG. 5, solid product 21 is initially supported on solid product support members 33 when the level 75 of the toilet tank water 63 reaches the FULL position. It should be noted that only that portion of the solid product 21 located intermediate the uppermost surface of support members 33 and the lowermost edge 62 of level control partition 32, i.e., vertical distance "H", is exposed to the water introduced into the interior of the dispenser 20.

Figure 7:
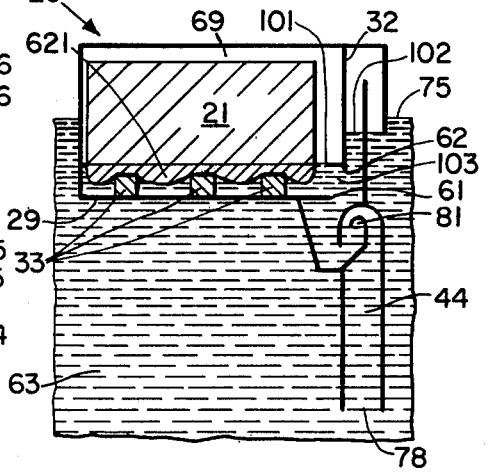

FIG. 7 depicts the condition of the solid product 21 after initiation of the gel formation stage. In particular, those portions of the solid product 21 in contact with the liquid within the dispenser have begun to form a gel 621. As the gel formed adjacent the uppermost surfaces of support members 33 begins to dissolve and/or disperse, it becomes incapable of supporting the weight of the solid product 21, and the solid product begins to settle further into the lowermost portion of product chamber 69. This of course exposes more of the solid product to the liquid solution contained within the dispenser.

Figure 8:
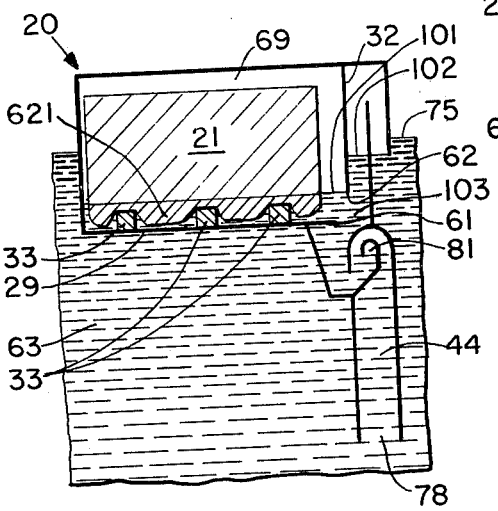

FIG. 8 represents a condition of the solid product 21 when the gel portion 621 has nearly contacted the bottom wall segment 29 of the dispenser 20. Provided the accumulation of gel in the lowermost portion of product chamber 69 does not substantially surpass the condition shown in FIG. 8, i.e., does not contact bottom wall segment 29 and block the flow of liquid entering or exiting the lowermost portion of product chamber 69, the dispenser 20 will function as shown in FIGS. 9 and 10 to dispense a predetermined quantity of liquid solution 103.

Experience has demonstrated that the liquid solutions formed by dissolution or dispersion of solid-state products which have a strong gel forming tendency are often highly viscous and/or resistant to flow, particularly when allowed to stand for long periods of time. Dispensers incorporating the novel anti-clogging means disclosed herein have been found advantageous in dispensing such solutions, even in situations where the quiescent periods intermediate flush cycles of the toilet are of long duration. Although the viscous or flow-resistant liquid tends to accumulate in the lowermost portions of liquid solution reservoir 65 during such extended quiescent periods, it has been observed that dispenser embodiments of the present invention are prone to discharge such viscous or flow-resistant materials and thereby unclog themselves after several closely spaced flush cycles. This unclogging tendency appears to be exhibited so long as: (1) the viscous or flow-resistant liquid accumulated in the liquid solution reservoir 65 is capable of being displaced by the small pressure differentials produced by the entering toilet tank water and the exiting liquid solution; and (2) liquid solution is able to enter and exit the lowermost portion of product chamber 69 with each flush cycle of the toilet.

As will be appreciated by those skilled in the art, the greater the gravitational head of the liquid solution contained in the internal reservoir of dispenser 20, the greater will be the available driving force during the dispensing cycle. Accordingly, the stronger the tendency of the solid product to form viscous or flow-resistant solutions, the greater should be the vertical separation between the liquid solution contained in product chamber 69 and passageway 71 relative to lowermost edge 67 of interior partition 96.

Figure 9:
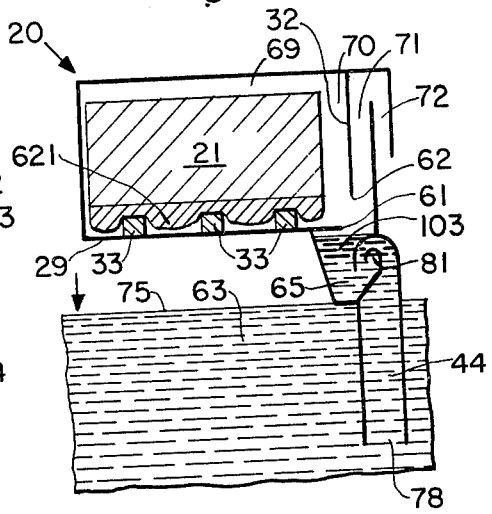
Figure 10:
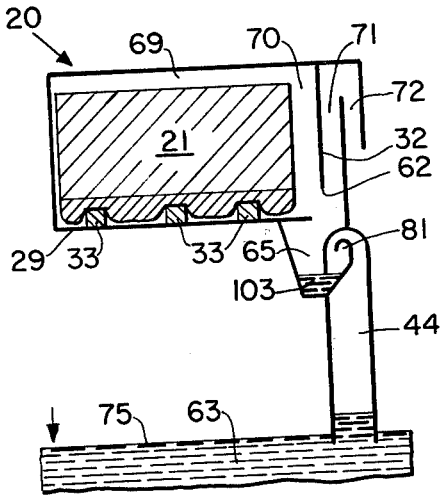

FIG. 9 represents the condition of the dispenser 20 upon flushing of the toilet. As the water level 75 begins to fall below the dispenser 20, liquid solution 103 is drawn from the lowermost portion of product chamber 69, the lowermost portion of vertical passageway 71 and from liquid solution reservoir 65 into syphon tube 44. Because the incompletely dissolved gel portion 621 of solid product 21 does not normally separate from solid product 21, it is retained within the lowermost portion of product chamber 69 during the dispensing cycle. Accordingly, undissolved gel-like materials are prevented from obstructing the flow of liquid solution 103 in either the lowermost portions of liquid solution reservoir 65 or the uppermost portions of syphon tube 44 during the dispensing cycle.

FIG. 10 represents a point in time when the syphon tube 44 is vented and the liquid product solution 103 retained therein is being dispensed into the toilet tank water. Provided the flow of liquid into and out of the lowermost portion of product chamber 69 has not been precluded, dispenser embodiments of the present invention function in a manner similar to dispenser embodiments of the type disclosed in FIGS. 1 and 15–18 of the aforementioned patent application of Robert S. Dirksing entitled PASSIVE DOSING DISPENSER EMBODYING TRAPPED AIR BUBBLE TO PROVIDE AIR-LOCK, said patent application being incorporated herein by reference.

When the level 75 of the toilet tank water 63 returns to the FULL position illustrated in FIG. 8, the dispenser 20 will likewise be restored to the condition illustrated in FIG. 8, and the dissolution or dispersion cycle described earlier herein will be re-initiated during the ensuing quiescent period, awaiting the next flush cycle of the toilet.

The dispenser embodiment 20 illustrated in FIG. 1 will discharge a predetermined quantity or dose-volume of liquid product solution 103 from the dispenser each time the toilet is flushed. The dose-volume of solution is substantially equal to the quantity of solution contained within dispenser 20 between lowermost edge 62 of level control partition 32 and lowermost edge 67 of partition segment 96 in addition to the column of product solution contained within passageway 71. The amount of liquid product solution 103 dispensed during each flush cycle is more easily understood by comparing FIG. 8, which illustrates the condition of the dispenser 20 when the toilet tank water level 75 is FULL and air vent 83 has been blocked by the water, with FIG. 10, which illustrates the condition of the dispenser when the liquid solution level within liquid solution reservoir 65 has reached lowermost edge 67 of partition segment 96 and the dose-volume of solution within syphon tube 44 has been released.

As has been pointed out earlier herein, the solid, water soluble product 21 contained in product chamber 69 will pass through a gel phase and ultimately dissolve or at least disperse in the water introduced during each flush cycle to form liquid product solution 103 until such time as the solution becomes saturated and equilibrium is achieved or until such time as the toilet is again flushed. As has also been pointed out earlier herein, the depth of immersion of solid product 21 is limited to the vertical distance "H" between the uppermost surface of support members 33 and the lowermost edge 62 of level control partition 32. Accordingly, ignoring buoyant forces, the weight of the solid product 21 is carried entirely on support member 33. As the gel 621 of height "H" intermediate the uppermost surface of support members 33 and the non-gelled portion of solid product 21 dissolves or disperses into liquid solution 103, the non-gelled portion of the solid product 21 will continue to settle, due to gravity, into the lowermost portion of product chamber 69. It is desirable in the practice of the present invention that the lowermost surface of solid product 21 dissolve or disperse substantially uniformly along its length. This avoids binding or cocking of solid product 21 within the uppermost portions of product chamber 69, and consequent malfunction of the dispenser before the solid product has been completely consumed. In addition it ensures that the volume and surface area of solid product 21 exposed to liquid will remain essentially constant throughout the life of the solid product. As a result, the strength or concentration of the solution 103 remains essentially constant throughout the life of the dispenser 20, assuming an adequately long quiescent period for the solution to become saturated is provided intermediate flush cycles. This condition will prevail at least until such time as the overall height of the solid product 21 becomes less than the vertical distance "H" between lowermost edge 62 of level control partition 32 and the uppermost surface of support members 33.

While the dispenser embodiment illustrated in FIG. 1 incorporates a preferred air trap 81 disposed adjacent the inlet/discharge conduit 80, the air trap utilized to retain an air bubble during the water charging operation may take many different forms. For example, a sudden expansion in cross-sectional flow area could be provided in vertical inlet passageway 88 followed immediately by a sudden contraction in flow area such that fluid entering the liquid solution reservoir 65 through the inlet/discharge conduit 80 is unable to exert sufficient force on the air bubble trapped within the expanded flow area to expel it through the liquid solution reservoir 65 and out the air vent 83. Alternatively, the air trap could take the form of a partial obstruction in inlet/discharge conduit 80, which partial obstruction prevents fluid passing through the conduit from exerting sufficient force on the air bubble retained within the trap from being expelled through the liquid solution reservoir 65 and out the air vent 83. It is necessary only that the air trap be of sufficient volume and so located that upon cessation of the flow of water past the air trap the air bubble contained therein will attempt to rise into the uppermost reaches of the chamber connecting the syphon tube and the inlet/discharge conduit so as to completely isolate the toilet tank water 63 in the syphon tube from the liquid product solution 103 contained in the inlet/discharge conduit.

Figure 11:
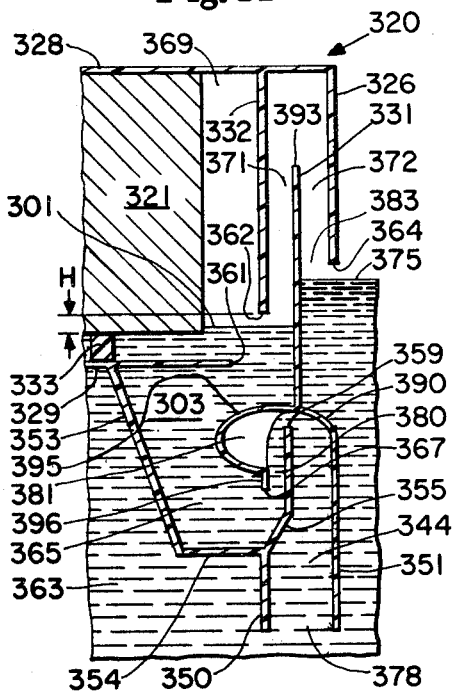
FIG. 11 is a fragmentary sectional view of yet another embodiment of a passive dosing dispenser of the present invention shown as the water level is rising in the toilet tank.

FIG. 11 is a fragmentary sectional view of an alternative embodiment of a dispenser 320 of the present invention shown during the initial water charging operation as the level 375 of water 363 in the toilet tank is rising. The dispenser 320 is basically similar to the dispenser 20 illustrated in FIG. 1. The illustrated portions of dispenser 320 comprise top wall 328, bottom wall segments 329, 353, 354, and 355, solid product support members 333, sidewall segments 326, 331, 350 and 351, interior level control partition 332, interior partition 395 forming air trap 381 and interior partition segment 396 which in conjunction with the uppermost portion of wall segment 350 forms inlet/discharge conduit 380. As with the embodiment of FIG. 1, a solid, water-soluble product 321 having a gel forming tendency is disposed within product chamber 369 such that its lowermost surface rests on the uppermost surfaces of solid product support members 333. The lowermost edge of level control partition 332 is designated 362, and is separated from the uppermost surface of solid product support members 333 by a vertical distance "H", similar to dispenser 20 illustrated in FIG. 1. The uppermost edge of wall segment 331 is designated 393, the lowermost edge of sidewall segment 326 is designated 364, the uppermost edge of sidewall segment 350 is designated 359 and the lowermost edge of partition segment 396 is designated 367. Product chamber 369 and liquid solution reservoir 365 are initially vented by means of passageways 371 and 372 and air vent 383 defined by edge 364 of sidewall segment 326, the front and back wall portions (not shown) of dispenser 320 and sidewall segment 331. In the case of dispenser 320, liquid solution reservoir 365 and product chamber 369 together comprise what is collectively referred to as an internal reservoir. Syphon tube 344 is defined by sidewall segments 350, 351 and 390 as well as the corresponding front and back wall portions (not shown) of dispenser 320. The inlet/discharge port located at the lowermost end of syphon tube 344 is designated 378. As with the embodiment illustrated in FIG. 1, the uppermost portions of the syphon tube are convergent, i.e., the radial distance from uppermost edge 359 of sidewall segment 350 to sidewall segment 390 and to interior partition 395 continually decreases in the direction of liquid flow, at least until the point of vertical alignment with sidewall segment 350. The air trap 381 formed by interior partition 395 is located adjacent the entrance to inlet/discharge conduit 380.

Figure 12:
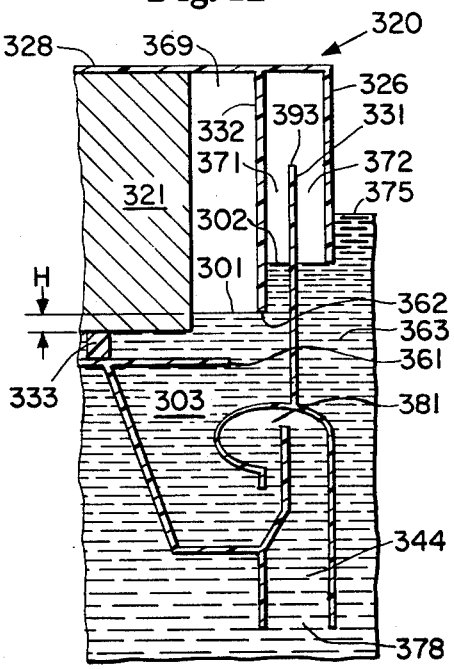
FIG. 12 is a fragmentary sectional view of the dispenser of FIG. 11 shown immediately after the water has reached its FULL level in the toilet tank.

In the condition illustrated in FIG. 11, the toilet tank water 363 has risen sufficiently in syphon tube 344 to trap an air bubble within air trap 381 as it proceeds to fill liquid solution reservoir 365 and the lowermost portions of product chamber 369. As long as the water continues to flow within the syphon tube and inlet/discharge conduit, the trapped air bubble will remain within the confines of the air trap 381. When, however, air vent 383 is blocked by the rising toilet tank water 363 as shown in FIG. 12, fluid flow in the inlet/discharge conduit 380 ceases, and the trapped air bubble rises, thereby providing air-lock isolation of the liquid product solution 303 and the toilet tank water 363 on opposite sides of edge 359 of sidewall segment 350. The product solution 303 at level 302 within passageway 371 is likewise isolated from the toilet tank water by means of the air-lock contained in the uppermost reaches of passageways 371 and 372. The level 301 of liquid product solution 303 within dispenser 320 is defined by lowermost edge 362 of level control partition 332 in a manner similar to that described in connection with embodiment 20 of FIG. 1. The solid product dissolution cycle which takes place within dispenser 320 is essentially the same as that of dispenser 20, as shown in FIGS. 5–8. When the toilet is flushed, dispenser embodiment 320 reacts in a manner similar to embodiment 20, as shown in FIGS. 9 and 10. When the level of liquid solution in liquid solution reservoir 365 reaches lowermost edge 367 of partition segment 396, the column of liquid retained within syphon tube 344 is vented, thereby dispensing a predetermined quantity of liquid product solution 303 into the toilet tank through inlet/discharge port 378.

Figure 14:
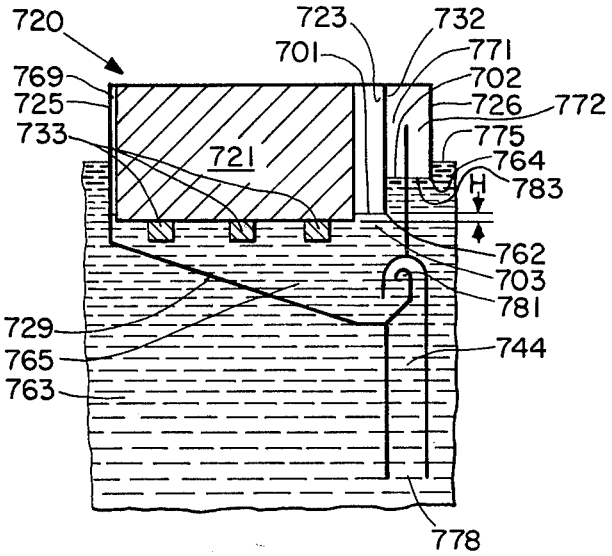
FIG. 14 is a simplified schematic illustration of still another embodiment of the present invention shown immediately after the water has reached its FULL level in the toilet tank.

FIG. 14 discloses an alternative dispenser embodiment 720 of the present invention. The dispenser embodiment 720 illustrated in FIG. 14 is, with the exception of relocation of bottom wall segment 729 from the bottom of solid-state product chamber 769 to the bottom of liquid solution reservoir 765 similar to dispenser embodiment 20 shown in FIG. 1. Solid product support members 733 correspond to solid product support members 33 of dispenser 20, with the exception that they are supported from the back wall 723 of dispenser 720. The uppermost surfaces of product support members 733 are likewise separated by a vertical distance "H" from the lowermost edge 762 of the level control partition 732. The lowermost edge 762 of level control partition 732, which corresponds to lowermost edge 62 of level control partition 32 in dispenser 20, fixes the level 701 of the resultant liquid product solution 703 formed by dissolution of solid product 721 within product chamber 769, while the level 702 of liquid product solution 703 in passageway 771 coincides with that in passageway 772 and is controlled by the vertical positioning of air vent 783 which coincides with lowermost edge 764 of sidewall 726.

In the condition illustrated in FIG. 14, the level 775 of toilet tank water 763 has reached its FULL position and the liquid solution 703 within dispenser 720 has been isolated from the surrounding tank water. Solid-state product 721 has been immersed in the liquid contained within the dispenser a distance "H", and the gel formation stage is just being initiated.

As will be apparent from an inspection of FIG. 14, the lowermost portion of product chamber 769 is coextensive with the uppermost portion of liquid solution reservoir 765 along its entire length. Accordingly, liquid solution 703 within liquid solution reservoir 765 can readily enter product chamber 769 and contact the lowermost portions of solid product 721 along its entire length. This increased area of fluid communication between product chamber 769 and liquid solution reservoir 765 permits more gel to be formed without precluding liquid contained within the dispenser from entering or exiting the product chamber when the toilet is flushed. The dispenser 720 shown in FIG. 14 is, therefore, generally preferred over the dispenser 20 shown in FIG. 1 for solid-state products having more pronounced gelling tendencies. Furthermore, the increased volume of liquid within liquid solution reservoir 765 results in a greater volume of liquid being dispensed with each flush of the toilet. In those situations where a saturated equilibrium state is not reached, this provides a less concentrated liquid solution for a given period of time intermediate flush cycles of the toilet, thereby reducing the tendency to form highly viscous and/or flow-resistant solutions.

As will also be apparent from FIG. 14, any gel formed by the immersed lowermost portion of solid-state product 721 is free to project into the uppermost portions of liquid solution reservoir 765 without impairing the dispensing operation. Furthermore, the downward slant of bottom wall segment 729 promotes drainage of the liquid from that portion of product chamber 769 nearest sidewall segment 725 into the lowermost reaches of liquid solution reservoir 765 with each flush cycle of the toilet. This liquid movement promotes further dissolution and/or dispersion of the gel associated with solid-state product 721, thereby minimizing the chance of clogging the dispenser.

While the exemplary embodiments of dispensers 20, 320, 520 and 720 may be constructed by adhesively securing sections of relatively rigid Plexiglas (Registered Trademark of Rohm & Haas Company) to one another, other relatively rigid materials which are substantially inert with respect to the intended product and aqueous solutions thereof can be used to construct the dispensers. Furthermore, the dispensers may be constructed or formed at high speed and relatively low cost utilizing various manufacturing techniques well known in the art. For example, the dispensers could be vacuum thermoformed in two sections of a material such as polyvinyl chloride having an initial thickness of about 0.02 inches, the solid, water-soluble product inserted therebetween and the two sections thereafter secured to one another as by heat sealing, adhesives, etc. along a line of contact substantially coinciding with the location of section line 2—2 of FIG. 1 or section line 10—10 of FIG. 9. Alternatively the full thickness dispenser configuration may be formed in one segment, the water soluble product inserted therein and the land areas of the full thickness segment subsequently secured to a planar segment to form the desired dispenser assembly.

With dispenser embodiments of the present invention, the discharge of liquid product solution is near the end of the flush cycle. The latter feature is highly desirable, since it ensures that more of the product solution dispensed during each flush cycle will be retained in the bowl after the flush cycle has been completed, and thus will be at a higher concentration than if it were dispensed during the early portions of the flush cycle. This is so because of the inherent operation of a flushing toilet. Generally all the water from the toilet tank goes through the toilet bowl. However, the initial portions of water are used to initiate a syphon action in the toilet bowl which carries away the waste material, while the latter portions are used to refill the toilet bowl. By dispensing the product solution into the latter discharged portions of the tank water a higher solution concentration in the toilet bowl is provided intermediate flush cycles. If the product solution were dispensed into the initially discharged portions of the toilet tank water, a large portion of the solution would be carried away with the waste material so that the concentration of solution remaining in the toilet bowl would be greatly reduced.

Dispensers of the present invention are particularly well suited for plural component products which need to be isolated from each other prior to use. Each dispenser section of such a dual or plural product dispenser will maintain a product component in isolation from the toilet tank water and from the other product components disposed in other independent sections. Such plural product dispensing embodiments could be fabricated as a single unit, suspended in the toilet tank independently of one another, or interdependently suspended in the toilet tank by means of a common bracket or the like. Because the constant volume of solution dispensed during each flush cycle may readily be determined, it is thus possible to size such plural product dispensers so that each of the product components will be completely consumed at about the same point in time, thereby minimizing waste of any particular component.

While particular embodiments of the present invention have been illustrated and described, it will be obvious to those skilled in the art that various changes and modifications can be made without departing from the spirit and scope of the invention and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dosing dispenser for containing a quantity of a liquid solution formed by dissolution of a solid-state product having a gel forming tendency isolated from a body of liquid in which said dispenser is immersed and for causing a predetermined dose-volume of said liquid solution to issue from said dispenser in response to the level of said body of liquid being lowered from a first elevation to a second elevation, said dispenser comprising:

a. an internal reservoir for containing a quantity of said liquid solution;

b. liquid syphoning means in fluid communication with said reservoir for conveying a predetermined dose-volume of said solution from said reservoir into said body of liquid in which said dispenser is immersed in response to the level of said body of liquid being lowered from said first elevation to said second elevation, said syphoning means including passive means for providing a first air-lock in the path of fluid communication between said reservoir and said syphoning means when said dispenser is immersed in said body of liquid;

c. an air vent in fluid communication with said reservoir, said air vent including passive means for providing a second air-lock in the path of fluid communication between said reservoir and said air vent when said dispenser is immersed in said body of liquid to a depth sufficient to block said air vent, whereby said first air-lock and said second air-lock serve to isolate said liquid solution from said body of liquid until such time as said body of liquid is lowered from said first elevation to said second elevation; and d. clog prevention means in said internal reservoir to prevent the gel formed during dissolution of said solid-state product from obstructing the flow of said liquid solution within said internal reservoir and said liquid syphoning means.

2. The passive dosing dispenser of claim 1, wherein said internal reservoir comprises a solid-state product chamber and a liquid solution reservoir located beneath and in fluid communication with said product chamber.

3. The passive dosing dispenser of claim 2, wherein said liquid syphoning means comprises a syphon tube having an open lower end and an inlet/discharge conduit, said inlet/discharge conduit having a top end in fluid communication with the upper reaches of said syphon tube and a bottom end in fluid communication with said liquid solution reservoir and said means for providing a first air-lock comprises an air trap disposed adjacent said inlet/discharge conduit and in exclusive fluid communication therewith.

4. The passive dosing dispenser of claim 3, wherein said clog prevention means comprises:

a. means to prevent the gel formed during dissolution of said solid-state product from obstructing the flow of said liquid solution into or out of the lowermost portion of said solid-state product chamber; and b. means for controlling the amount of solid-state product exposed to said liquid solution in said internal reservoir.

5. The passive dosing dispenser of claim 4, wherein the lowermost portion of said solid-state product chamber is co-extensive with the uppermost portion of said liquid solution reservoir and is in fluid communication therewith along its entire length.

6. The passive dosing dispenser of claim 4 or claim 5, wherein said means for controlling the amount of solid-state product exposed to said liquid solution in said internal reservoir comprises:

a. at least one solid-state product support member in the lowermost portion of said solid-state product chamber; and b. liquid level control means for controlling the height of said liquid solution within said solid-state product chamber.

7. The passive dosing dispenser of claim 6, wherein said liquid level control means comprises a level control partition within said solid-state product chamber.

8. The passive dosing dispenser of claim 7, wherein the lowermost edge of said level control partition is vertically spaced a maximum of about $\frac{3}{8}$ inch from the uppermost surface of said product support member.

9. The passive dosing dispenser of claim 6, wherein said liquid level control means comprises said air vent.

10. The passive dosing dispenser of claim 6, wherein said solid-state product support member comprises a protuberance extending from a wall of said product chamber.

11. A passive dosing dispenser for containing a quantity of a liquid solution formed by dissolution of a solid-state product having a gel forming tendency isolated from a body of liquid in which said dispenser is immersed and for causing a predetermined dose-volume of said liquid solution to issue from said dispenser in response to the level of said body of liquid being lowered from a first elevation to a second elevation, said dispenser comprising:

a. an internal reservoir for containing a quantity of said liquid solution;

b. liquid syphoning means in fluid communication with said reservoir for conveying a predetermined dose-volume of said solution from said reservoir into said body of liquid in which said dispenser is immersed in response to the level of said body of liquid being lowered from said first elevation to said second elevation, said syphoning means including passive means for providing a first air-lock in the path of fluid communication between said reservoir and said syphoning means when said dispenser is immersed in said body of liquid;

c. an air vent in fluid communication with said reservoir, said air vent extending above said first elevation of said body of liquid when said dispenser is immersed in said body of liquid, whereby said air-lock and said air vent serve to isolate said solution from said body of liquid until such time as said body of liquid is lowered from said first elevation to said second elevation; and d. clog prevention means in said internal reservoir to prevent the gel formed during dissolution of said solid-stproduct from obstructing the flow of said liquid solution within said internal reservoir and said liquid syphoning means.

12. The passive dosing dispenser of claim 11, wherein said internal reservoir comprises a solid-state product chamber and a liquid solution reservoir located beneath and in fluid communication with said product chamber.

13. The passive dosing dispenser of claim 12, wherein said liquid syphoning means comprises a syphon tube having an open lower end and an inlet/discharge conduit, said inlet/discharge conduit having a top end in fluid communication with the upper reaches of said syphon tube and a bottom end in fluid communication with said liquid solution chamber and said means for providing a first air-lock comprises an air trap disposed adjacent said inlet/discharge conduit and in exclusive fluid communication therewith.

14. The passive dosing dispenser of claim 13, wherein said clog prevention means comprises:

a. means to prevent the gel formed during dissolution of said solid-state product from obstructing the flow of said liquid solution into or out of the lowermost portion of said solid-state product chamber; and b. means for controlling the amount of solid-state product exposed to said liquid solution in said internal reservoir.

15. The passive dosing dispenser of claim 14, wherein the lowermost portion of said solid-state product chamber is co-extensive with the uppermost portion of said liquid solution reservoir and is in fluid communication therewith along its entire length.

16. The passive dosing dispenser of claim 14 or claim 15, wherein said means for controlling the amount of solid-state product exposed to said liquid solution in said internal reservoir comprises:

a. at least one solid-state product support member in the lowermost portion of said solid-state product chamber; and b. liquid level control means for controlling the height of said liquid solution within said solid-state product chamber.

17. The passive dosing dispenser of claim 16, wherein said liquid level control means comprises a level control partition within said solid-state product chamber.

18. The passive dosing dispenser of claim 17, wherein the lowermost edge of said level control partition is vertically spaced a maximum of about $\frac{3}{8}$ inch from the uppermost surface of said product support member.

19. The passive dosing dispenser of claim 16, wherein said liquid level control means comprises said air vent.

20. The passive dosing dispenser of claim 16, wherein said solid-state product support member comprises a protuberance extending from a wall of said product chamber.

* * * * *

UNITED STATES PATENT AND TRADEMARK OFFICE

CERTIFICATE OF CORRECTION

PATENT NO. : 4,307,474

DATED : December 29, 1981

INVENTOR(S) : CLEMENT K. CHOY

It is certified that error appears in the above-identified patent and that said Letters Patent are hereby corrected as shown below:

Column 16, line 64, "solid-stproduct" should read -- solid-state product --.

Signed and Sealed this

*Fifteenth* Day of *June 1982*

[SEAL]

*Attest:*

GERALD J. MOSSINGHOFF

*Attesting Officer*

*Commissioner of Patents and Trademarks*